US005545011A

United States Patent [19]

Molin et al.

[11] Patent Number: 5,545,011

[45] Date of Patent: Aug. 13, 1996

[54] ANGLE ADJUSTABLE VANE SUSPENSION

[75] Inventors: Jan Molin, Växjö; Sören Gränfors, Rottne, both of Sweden

[73] Assignee: ABB Flakt AB, Stockholm, Sweden

[21] Appl. No.: 406,877

[22] PCT Filed: Sep. 24, 1993

[86] PCT No.: PCT/SE93/00771

§ 371 Date: Mar. 27, 1995

§ 102(e) Date: Mar. 27, 1995

[87] PCT Pub. No.: WO94/09264

PCT Pub. Date: Apr. 28, 1994

[30] Foreign Application Priority Data

Oct. 14, 1992 [SE] Sweden ..... 9203017

[51] Int. Cl.[6] ..... F01D 5/30

[52] U.S. Cl. ..... 416/207; 416/208; 416/214 R; 416/220 A

[58] Field of Search ..... 416/207, 208, 416/214 R, 220 A

[56] References Cited

U.S. PATENT DOCUMENTS

| | | | |
|---|---|---|---|
| 2,246,539 | 6/1941 | Ruths et al. . | |
| 2,844,207 | 7/1958 | Curley . | |
| 4,150,921 | 4/1979 | Wennberg et al. | 416/208 |
| 4,715,784 | 12/1987 | Mosiewicz | 416/208 |
| 4,877,376 | 10/1989 | Sikorski et al. | 416/207 |

FOREIGN PATENT DOCUMENTS

| | | | |
|---|---|---|---|
| 2439767 | 3/1976 | Germany | 416/207 |
| 0638856 | 6/1950 | United Kingdom | 416/208 |
| 1324385 | 7/1973 | United Kingdom . | |
| 2226087 | 6/1990 | United Kingdom | 416/208 |

*Primary Examiner*—Edward K. Look
*Assistant Examiner*—Mark Sgantzos
*Attorney, Agent, or Firm*—Burns, Doane, Swecker & Mathis, L.L.P.

[57] ABSTRACT

A vane suspension for angle adjustable mounting of a vane (6) in a hub (1), comprising a seat (3) in the hub and a mounting part on the vane (6). The mounting part on the vane comprises a stud (16) and a shoulder (17) provided at the end of the stud with a partly spherical contact surface (19) facing the blade (15) of the vane, and in that the seat (3) of the hub has a hub shoulder (10) with a partly cylindrical contact surface (12) radially facing the center of the hub (2), which two surfaces are arranged to cooperate mutually by linear contact, whereby the position of the line (21, 21') is constant irrespective of the angular position of the vane in relation to the hub.

20 Claims, 4 Drawing Sheets

ANGLE ADJUSTABLE VANE SUSPENSION

FIELD OF INVENTION

The present invention relates to an angle adjustable suspension of vanes in a hub, comprising a seat in the hub and a mounting part on the vane.

PRIOR ART

There is a need for adjusting the angles of vanes on blade wheels in order to adjust the characteristics of the blade wheel to existing conditions and desires. There are solutions which allow adjustment of the angle of the vanes also during operation as well as automatic adjustment of the angle of the vane depending on current load.

U.S. Pat. No. 2,844,207 discloses an adjustable fan blade means, wherein the fan blades can be adjusted individually when the fan wheel rests. The fan blades are axially locked, for uptake of rotational load, by a lock washer which abuts a shoulder in the hub and the adjusted angular position is maintained with the aid of a locking screw which is forced against the blade stud, which extends through a peripheral hole in the hub. With this construction the torsional moment as well as the bending moment will be taken up only by the friction between the abutment surface of the locking screw and the periphery of the blade stud. This solution is not satisfactory for fastening of vanes being exposed to large loads and does not give sufficient safety margins for the uptake of the rotational load and the bending moment.

DESCRIPTION OF THE INVENTION

The main object of the present invention is to provide an adjustable vane suspension in a hub, which gives a safe hold of the vane in the hub and at the same time allows for a quick and exact individual angular adjustment of the vane.

This and other objects of the present invention are achieved by the vane suspension according to the present invention which is characterized in that the mounting part on the vane comprises a stud and a shoulder provided at the end of the stud with a partly spherical contact surface facing the blade of the vane, and in that the seat of the hub has a hub shoulder with a partly cylindrical contact surface radially facing the centre of the hub, which two surfaces are arranged to mutually cooperate by linear abutment, whereby the position of the line (21,21') is constant irrespective of the angular position of the vane in relation to the hub.

Through the cooperating, partly spherical and partly cylindrical contact surfaces, respectively, an effective and secure uptake of the load from the rotational load through shearing is achieved. The design of the respective contact surfaces of the hub shoulder and the vane stud results in a compression load distributed in linear contact, the geometrical position of which is constant at different angular adjustments of the vane. In practice, a compression load deformation takes place so that the contact takes place over a certain area, while at the same time the material is deformation annealed in this area, which is favourable from a resistance point of view. In order to satisfy casting demands the cylindrical contact surface of the hub shoulder can be given a certain inclination.

According to one embodiment of the present invention the vane shoulder further has one at least partly cylindrical peripheral surface with a hole that extends through the shoulder, and the hub seat has a recess situated radially inwards of the hub shoulder for frictional cooperation with the cylindrical peripheral surface of the vane shoulder as well as a hole surrounded by an abutment surface arranged on the outside of the hub, whereby a clamping means is intended to be introduced through said hole in order to, though pre-stressing, generate a frictional force between vane shoulder and hub shoulder, which maintains an adjusted angular vane position.

By designing the seat of the hub with a recess having mutually inclined surfaces the torque can be taken up separately by a counteracting frictional moment between the restriction surfaces of the recess and the vane shoulder. Advantageously, the clamping means can be comprised of a through screw and nut and washer. When the screw is fastened with its prestressing load two reaction forces result which to the rate will be substantially larger than the clamping force because of the inclined contact surfaces. Thus an enlargement of the available counter frictional moment will be achieved, since this is proportional to the resulting reaction forces.

According to a further embodiment of the invention, the hole in the seat of the hub has the form of a slit and the abutment surface for the clamping means is cylindrical. Hereby an adjustment of the vane blade in different angular positions is possible by that the clamping means first is loosened, the vane blade is turned into the desired position and the clamping means is then fastened again.

According to an alternative embodiment of the invention the hole in the vane shoulder is designed to allow adjustment of the vane into different angular positions in that the hole is formed as a slit. According to a further development, the hole through the vane shoulder can be formed as a slit at the respective peripheral opening, tapering inwards towards the centre of the stud in order to have an extension substantially corresponding to the cross sectional form of the clamping means. With this design the position of the clamping means on the outside of the hub will always be on the same place irrespective of the angular position, which facilitates assembly with machine tools. Change of the angular position for all vanes on the hub can thus be made with only one tool.

According to a development of the invention the height of the cylindrical peripheral surface on the hub shoulder is adapted so that the frictional moment between the contact surfaces of the hub shoulder and the vane shoulder, respectively, has the ability to receive a bending moment that is generated by air forces acting on the vane blade. The length of the cylindrical vane shoulder forms a lever for this frictional force and can be adjusted in order to take up the expected bending moment.

BRIEF DESCRIPTION OF THE DRAWINGS

In the accompanying drawings a preferred embodiment is shown, which is described more specifically below, wherein.

DESCRIPTION OF A PREFERRED EMBODIMENT

Figure 1:
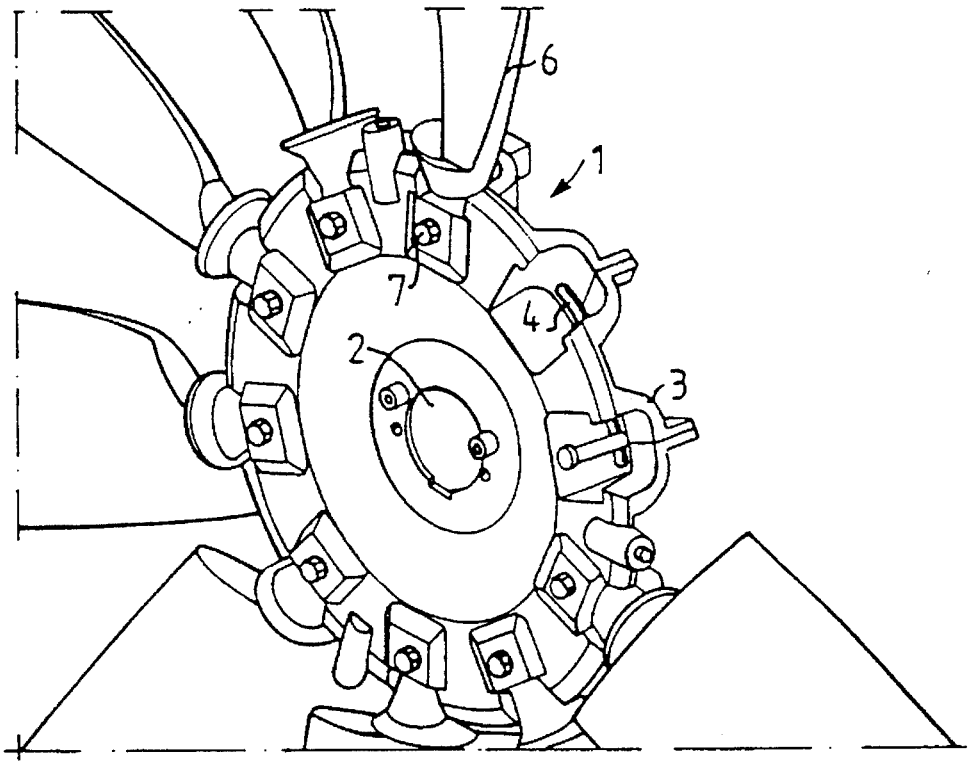
FIG. 1 shows a perspective view of a hub for a vane wheel.

In FIG. 1 a hub is shown, generally designed with 1, for a blade wheel with a centre hole 2 and vane seats 3 evenly distributed over the periphery. The seats are identical and only one seat will therefore be described.

Figure 2:
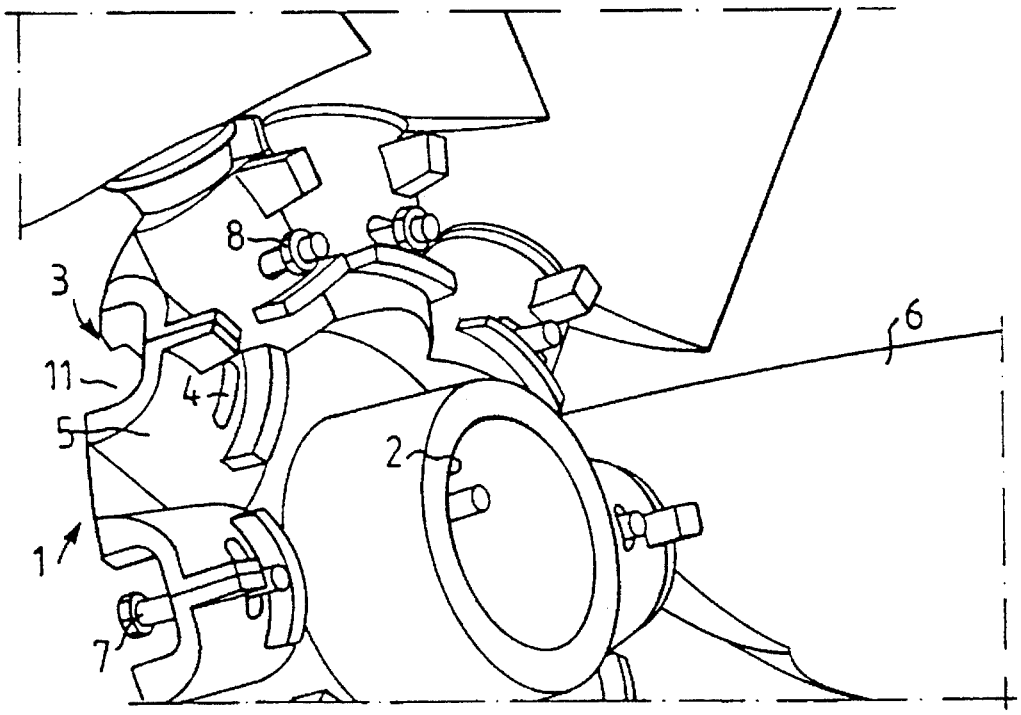
FIG. 2 shows a partial perspective view of the hub of FIG. 1, seen from the opposite side.

In FIG. 2 part of the opposite side of the hub shown in FIG. 1 is shown. In the embodiment shown each seat 3 has a slit 4, which slits on the side shown in FIG. 2 each are surrounded by a cylindrical abutment surface 5, the object of which will be described more in detail below. Further, the seats are evenly distributed over the periphery of the hub. Vanes 6 are clamped in the seats 3 with the aid of clamping means, which in the embodiment shown are comprised of bolt 7 with nut 8.

Figure 3A:
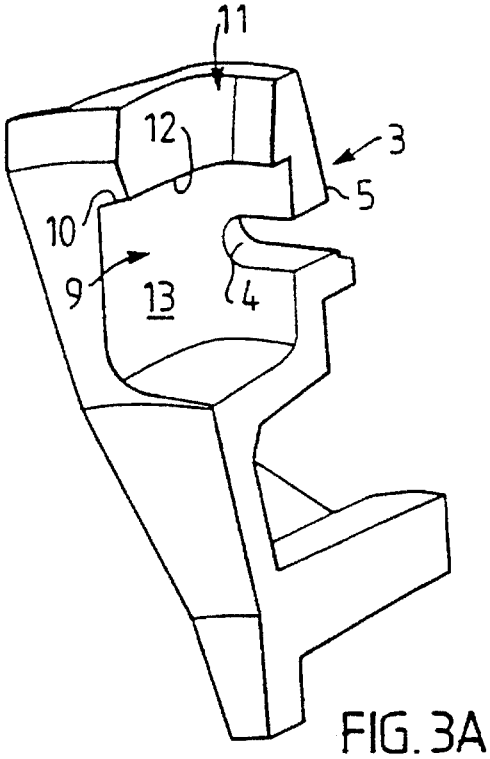
FIG. 3*a* and 3*b* show a partial cross sectional view of the hub from different angles.
Figure 3B:
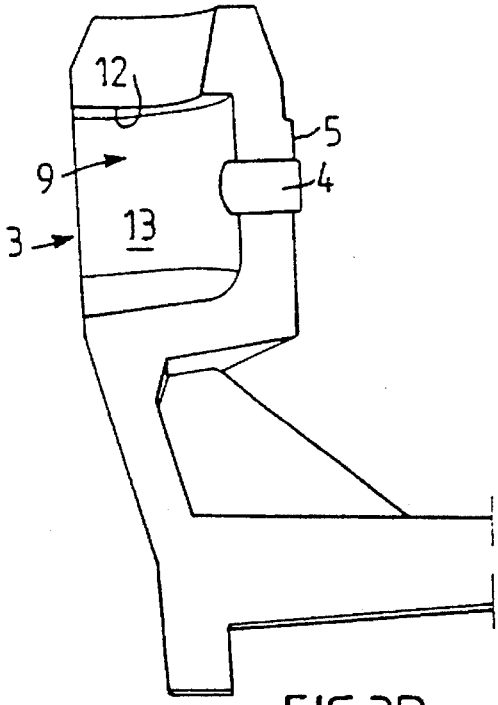

In FIG. 3*a* a partial cross sectional perspective view of a seat 3 is shown and in FIG. 3*b* the same partial cross sectional view is shown from the side. The seat 3 comprises a shoulder 10 extending beyond a recess 9 in the hub 1, which shoulder surrounds an opening 11 confined on three sides and open on the fourth side for the insertion of a vane stud. The extending shoulder has a partly cylindrical contact surface 12.

The slit 4 is arranged in the bottom of the recess, i.e. the radial part of the hub, towards which the two opposite sides 13,13' (only one is shown in this view) converge.

Figure 4:
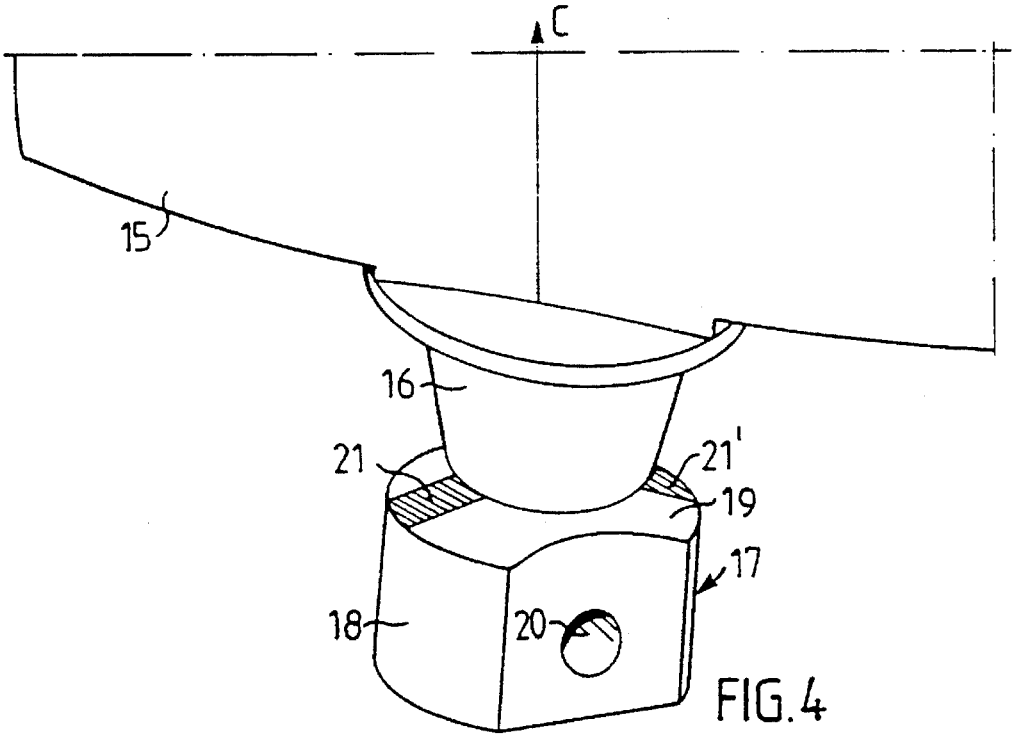
FIG. 4 shows a frontal view of the mounting part of a vane blade designed in accordance with the invention.

In FIG. 4, a vane 6 is shown with vane blade 15, vane stud 16 and a vane shoulder 17 provided on the stud. When putting together the parts, the stud 16 is introduced into the opening 11 so that the vane shoulder lands in the recess 9 of the seat. The vane shoulder 17 has a cylindrical peripheral surface 18 as well as a partly spherical contact surface 19 facing the vane and surrounding the stud. Further, a through hole 20 is arranged in the shoulder 17.

Further, in FIG. 4 is schematically shown the abutment surface 21,21' resulting from the compressive load deformation between the partly spherical contact surface 19 on the vane shoulder 17 on the one side and the partly cylindrical contact surface 12 on the hub shoulder 10, on the other side. The centrifugal force acting in the direction of the arrow C results in yield and said deformation. The size of the area 21,21' is much over-emphasized in the figure. With the structure according to the invention is achieved that, irrespective of the angular position of the vane, the geometrical position of the contact will always be exactly the same. Because of the yield the material is strain-hardened.

Figure 5:
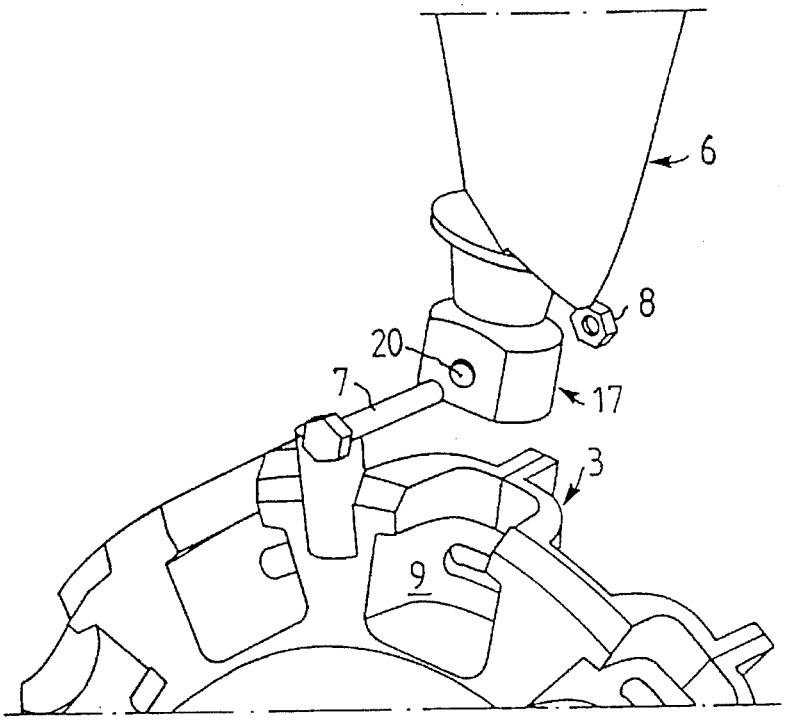
FIG. 5 shows an exploded view of part of the hub, the mounting part of a vane blade as well as a clamping means.

In FIG. 5 an exploded view is shown with the vane 6 above the seat 3. At assembly the vane shoulder 17 is put into the recess 9. The bolt 7 is introduced through the hole 20 in the vane shoulder and through the slit 4, whereupon the nut 8 is fastened from the opposite side of the hub.

Figure 6:
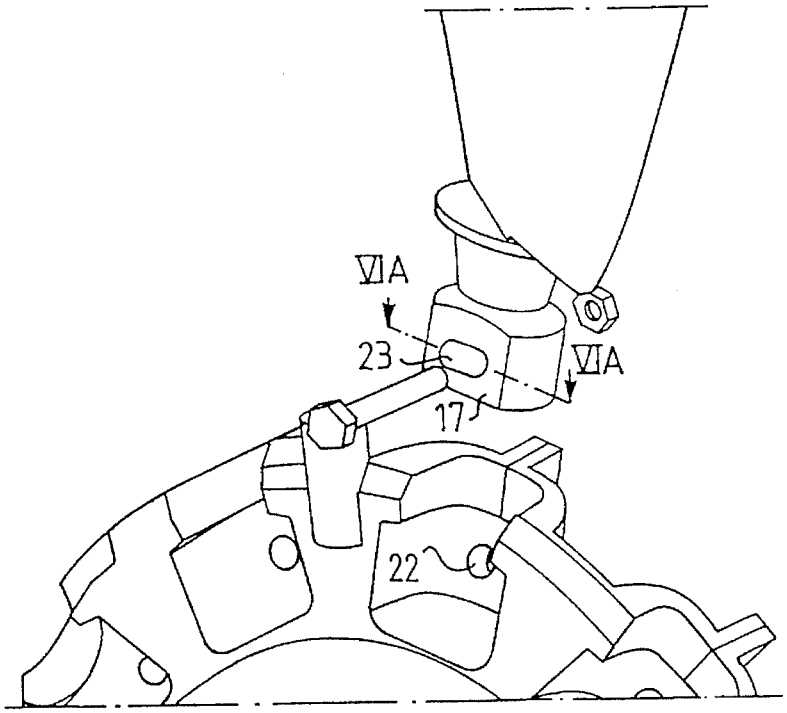
FIG. 6 shows a view corresponding to that in FIG. 5 for an alternative embodiment of the angularly adjustable mounting of the vane blade.
Figure 6A:
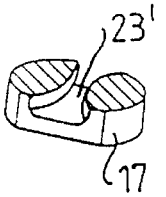
FIG. 6*a* shows a cross sectional view through the vane shoulder according to an advantageous embodiment.

In FIG. 6 a view corresponding to that in FIG. 5 is shown. Hereby the angular adjustability is arranged in the vane shoulder contrary to the previous embodiment. Thus the slit 4 in the recess 9 of the seat 3 is replaced by a hole 22 while the hole 20 in the vane shoulder 17 is replaced by a slit 23. Thanks to the conically tapering recess 9 of the seat the slit may be through without affecting the axial alignment of the vane. In order to secure the axial alignment of the vane, however, the slit 23 in the vane shoulder may be designed as is shown in FIG. 6*a*, at 23', so that its middle part has a cross section which substantially corresponds to the cross section of the clamping means, while it is enlarged towards the respective peripheral opening.

Figure 7:
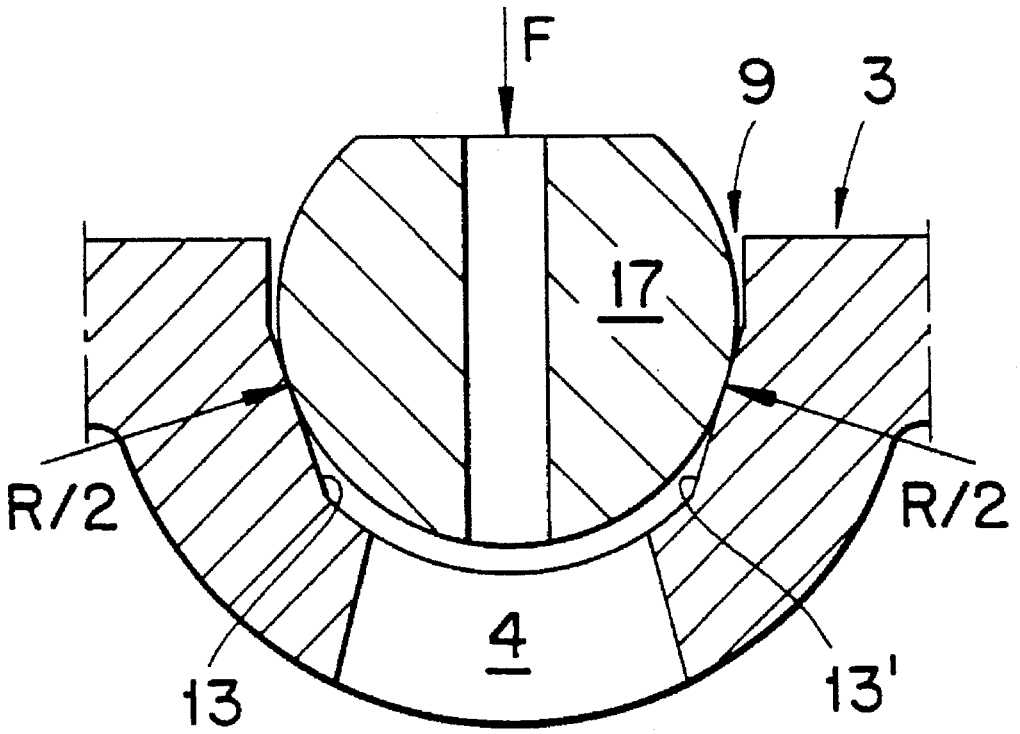
FIG. 7 shows a schematical, cross-sectional view, partly cut away, which illustrates pre-stressing force vs. reaction forces at the mounting according to the invention.

In FIG. 7 a partly cutaway cross sectional view is schematically shown, taken through a recess in the hub and the vane shoulder provided therein. Thanks to the design of the recess with two surfaces 13,13' converging towards each other, the force F, which is applied with the aid of a clamping means through the vane shoulder and the hub, gives rise to two reaction forces, which are totally equal to R, and in the case shown, where the force F acts in the direction towards the point of intersection of the two converging surfaces 13,13', the reaction forces are each equal to R/2. At other angular adjustments the reaction forces will be unequal, but the size of the sum of the two reaction forces is still substantially as large. The size of the reaction forces in relation to the pre-stressing force depends on the angle choosen for the two surfaces converging towards each other and can be made larger or smaller. In the case shown with a convering angle of about 19°, R will be about 3×F.

The cylindrical part of the vane shoulder will act as a lever for the friction between the contact surfaces 12 and 19 and by adapting this height to the expected bending moment which is generated by the air forces acting on the vane blade, this can be compensated for with the desired safety.

Experimental Results

Test 1

The mounting according to the invention was tested in view of inherent frequency as well as endurance limit for vane stud and hub seat.

With an absolutely fixed mounting the theoretical inherent frequency is 108 Hz. The lowest inherent frequency for the mounting according to the invention was 100 Hz, which is a very good result.

Test 2

In order to make sure that the angular position of the vanes are not changed because of the torque load a frictional moment of 38 Nm is necessary. In the tests a tightening moment for the screw passing through the vane stud and the slit in the hub seat being 25 Nm was used. Hereby a frictional moment of 125 Nm was obtained, which gives tripple safety.

Test 3

The endurance limit should be such that the probability for rupture does not exceed 1/1000 for 50,000 start and stop cycles. In the test, for this probability at least 113,000 cycles for the vane stud was achieved, while for the hub no ruptures were obtained in any test after more than 200,000 cycles.

The above tests show that the mounting according to the invention is extremely dependable and makes possible a structure with more than tripple safety without that the components used have to be dimensioned more strongly compared with known structures.

Within the scope of the invention variations of the above described embodiment which at the time of the present application is the preferred embodiment of the invention, can be made. Thus, the clamping means may be comprised of a screw with nut and washer, but could also be comprised of a pull rod with a suitable lock outside the hub, in order to make an adjustment of the vane angles more convenient. Further, the design of the peripheral surface of the vane shoulder can be choosen otherwise in combination with another form of the recess in the seat of the hub.

We claim:

1. A vane suspension for angle adjustable mounting of a vane, comprising a vane and a hub having a center, a seat in the hub which receives a portion of the vane, said vane including a vane blade, a stud and a vane shoulder provided at an end of the stud, said vane shoulder having a partly spherical contact surface facing the vane blade, the seat of the hub having a hub shoulder with a partly cylindrical contact surface radially facing toward the center of the hub, the partly spherical contact surface of the vane shoulder and the partly cylindrical contact surface of the hub shoulder being arranged to mutually cooperate along a pair of linear contact regions, whereby the position of the linear contact regions is constant irrespective of an angular position of the vane in relation to the hub.

2. A vane suspension according to claim 1, wherein the vane shoulder has an at least partly cylindrical peripheral surface with a bore passing through the vane shoulder, the seat of the hub having a recess situated radially inwards of the hub shoulder for frictional engagement with the at least partly cylindrical peripheral surface of the vane shoulder and a bore surrounded by an abutment surface provided outside the hub, and fastening means having a portion positionable in said bore of the seat to create a frictional force between the vane shoulder and the seat of the hub to maintain an adjusted vane angle position, using pre-stressing.

3. A vane suspension according to claim 2, wherein the bore in the seat of the hub is a slit, the abutment surface against which abuts a portion of the fastening means having a cylindrical shape.

4. A vane suspension according to claim 2, wherein the bore in the vane shoulder is a slit, the bore in the seat corresponding in shape to a cross section of one portion of the fastening means so that another portion of the fastening means lying outside the hub has a fixed position in relation to the hub regardless of the angular position of the vane blade.

5. A vane suspension according to claim 2, wherein the bore through the vane shoulder has a middle part possessing a cross section that substantially corresponds to a cross section of a portion of the fastening means, said bore in the vane shoulder being enlarged away from the middle part.

6. A vane suspension according to claim 2, wherein the fastening means includes a through bolt and a nut arranged outside the hub.

7. A vane suspension according to claim 2, wherein the cylindrical peripheral surface of the vane shoulder has a height sufficient to receive a bending moment generated by air forces acting on the vane blade.

8. A vane suspension according to claim 1, wherein the seat of the hub comprises two inclined surfaces arranged at an acute angle relative to each other.

9. A vane suspension according to claim 3, wherein the fastening means includes a through bolt and a nut arranged outside the hub.

10. A vane suspension according to claim 4, wherein the fastening means includes a through bolt and a nut outside the hub.

11. A vane suspension according to claim 3, wherein the cylindrical peripheral surface of the vane shoulder has a height sufficient to receive a bending moment generated by air forces acting on the vane blade.

12. A vane suspension according to claim 4, wherein the cylindrical peripheral surface of the vane shoulder has a height sufficient to receive a bending moment generated by air forces acting on the vane blade.

13. A vane suspension according to claim 5, wherein the cylindrical peripheral surface of the vane shoulder has a height sufficient to receive a bending moment generated by air forces acting on the vane blade.

14. A vane suspension according to claim 6, wherein the cylindrical peripheral surface of the vane shoulder has a height sufficient to receive a bending moment generated by air forces acting on the vane blade.

15. A vane suspension according to claim 9, wherein the cylindrical peripheral surface of the vane shoulder has a height sufficient to receive a bending moment generated by air forces acting on the vane blade.

16. A vane suspension according to claim 2, wherein the recess in the seat of the hub comprises two inclined surfaces arranged at an acute angle relative to each other.

17. A vane suspension according to claim 3, wherein the recess in the seat of the hub comprises two inclined surfaces arranged at an acute angle relative to each other.

18. A vane suspension providing an angle adjustable mounting of a vane, comprising a vane and a hub, said vane including a vane blade and a mounting part, the mounting part having a vane shoulder provided with a partly spherical contact surface that faces towards the vane blade, said hub including a seat provided with a recess for receiving at least a portion of the mounting part, said seat having a hub shoulder provided with a partly cylindrical contact surface which engages the partly spherical contact surface of the vane shoulder.

19. A vane suspension according to claim 18, including a through bore extending through the hub and opening into the seat, and including fastening means for securing said vane relative to said hub, a portion of said fastening means extending through the bore in the hub.

20. A vane suspension according to claim 19, wherein said mounting part includes a through hole for being aligned with the through bore in the hub and for receiving a portion of the fastening means.

* * * * *